US006475002B2

(12) United States Patent
Delsole

(10) Patent No.: US 6,475,002 B2
(45) Date of Patent: Nov. 5, 2002

(54) SPARK PLUG WIRE BOOT SECURING SYSTEM

(76) Inventor: Robert Delsole, 86 Valley Rd., Larchmont, NY (US) 10538

( * ) Notice: Subject to any disclaimer, the term of this patent is extended or adjusted under 35 U.S.C. 154(b) by 25 days.

(21) Appl. No.: 09/882,121

(22) Filed: Jun. 18, 2001

(65) Prior Publication Data

US 2001/0029121 A1 Oct. 11, 2001

Related U.S. Application Data

(63) Continuation-in-part of application No. 09/354,752, filed on Jul. 29, 1999, and a continuation-in-part of application No. 08/918,046, filed on Aug. 25, 1997, now abandoned.

(51) Int. Cl.[7] ..... H01R 13/44
(52) U.S. Cl. ..... 439/127
(58) Field of Search ..... 439/125–128; 123/169 PH

(56) References Cited

U.S. PATENT DOCUMENTS 1,245,931 A * 11/1917 Lanman
1,928,520 A * 9/1933 Werner
3,193,615 A * 7/1965 Burrows
4,701,662 A * 10/1987 Yamanashi et al. ..... 439/125
4,906,202 A * 3/1990 Germ ..... 439/127
5,127,840 A * 7/1992 Bezusko et al. ..... 439/127
5,188,537 A * 2/1993 Itoh et al. ..... 439/127
5,344,328 A * 9/1994 Suggs ..... 439/127

FOREIGN PATENT DOCUMENTS

AU 146131 * 12/1949 ..... 439/125

* cited by examiner

*Primary Examiner*—Gary F. Paumen

(57) ABSTRACT

An automobile spark plug ignition conduit having an insulation terminal cap of a flexible, compressible moisture proof insulating material of a generally annular cross-section, a first open end for receiving an insulated electrical ignition wire, a second open end adapter to be placed over a ringed sleeve on the spark plug or distributor cap wire terminal and retained thereon, wherein the cap has an annular recess formed on the internal surface of the cap with concentric bands, to engage the hollow cap. The device keeps ignition wires from becoming disconnected due to engine and road vibrations. It is especially useful in racing environments.

8 Claims, 2 Drawing Sheets

FIG.1
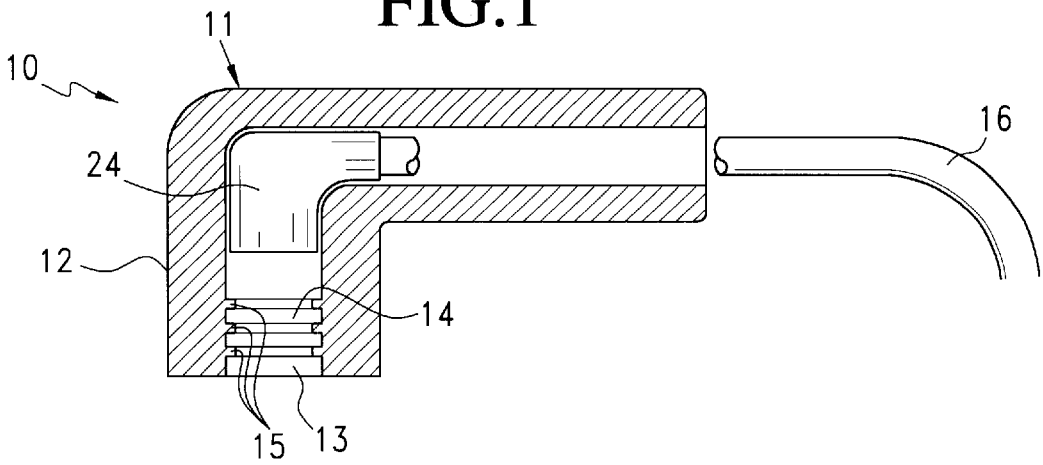
FIG.2a
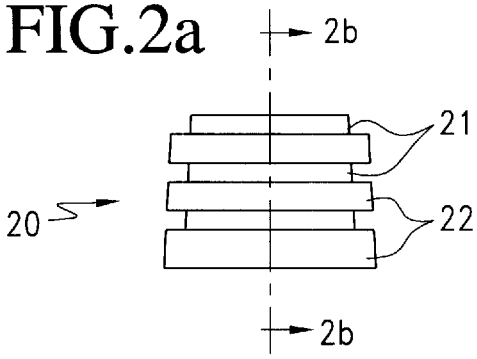
FIG.2b
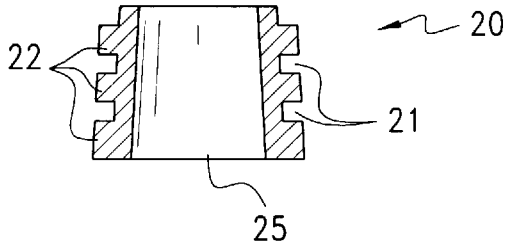
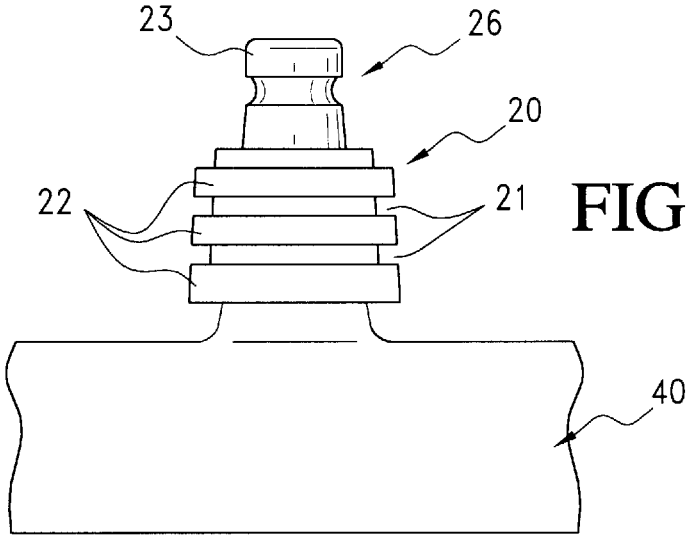
FIG.3

SPARK PLUG WIRE BOOT SECURING SYSTEM

CROSS-REFERENCE TO RELATED APPLICATIONS

This application is a continuation in part of Ser. No. 09/354,752 filed Jul. 29, 1999 and Ser. No. 08/918,046 filed Aug. 25, 1997, now abandoned.

STATEMENT REGARDING FEDERALLY SPONSORED RESEARCH OR DEVELOPMENT

Research and development of the present invention and application have not been federally sponsored, and no rights are given under any Federal program.

REFERENCE TO A MICROFICHE APPENDIX

Not applicable

BACKGROUND OF THE INVENTION

1. Field of the Invention

This invention relates to a means for securing the waterproof caps or boots of ignition wires to spark plugs, the distributor cap and/or coil on internal combustion engines.

2. Description of the Related Art Including Information Disclosed Under 37 CFR §§1.97–1.98

The boot or cap of the present invention is suitable for securing distributor wires and spark plug connections on internal combustion engines. The purpose is to provide a cap or boot wire connection which fits securely and tightly around the wiring and spark plug connector in order to prevent moisture from creeping into electric connection and especially to prevent the wire from vibrating off the plug during travel over rough roads and at high speeds typically encountered in the racing car environment. The present invention is particularly useful in racing cars, because the vibration and heat etc. involved in the high performance runs of such vehicles often cause a spark plug wire to either come completely off the ends of the spark plug and cause missing and loss of power in the engine or to become partially loose and cause a breakdown in the conductivity and degradation of the spark and consequent loss of power and an increase in vehicle emissions. Another area in which the improvement is of great value is marine engine applications.

Various remedies have been sought for this condition and said remedies generally include elaborate connecting means involving snaps and nuts bolted to secure the wire. Such designs are time consuming to connect and disconnect as well as adding measurable weight to a car which is particularly critical in racing environments.

Where time is at an extreme premium during pits stops in a race, it is essential that any service such as the necessary changing of spark plugs during the pit stop be effectuated in the minimum amount of time. Therefore, any complicated mechanical additions to the spark plug and/or wiring are unsuitable. It is essential, however, that the proper spark be assured continuously and this requires limiting the number of disconnects in the wiring harness.

The closest prior art references of which the applicant is aware are set forth in the following paragraphs.

At the present there is no suitable device available to accomplish applicant's objectives. The closest prior art reference from a general structural point of view is U.S. Pat. No. 3,193,615 to Burrows, disclosing a waterproof cap with an integral O-ring that serves primarily as a moisture seal, as opposed to a securing ring to prevent the cap from slipping off the end of the plug.

U.S. Pat. No. 5,344,328 to Suggs discloses a spark plug keeper which essentially has a ring shaped base which fits under the lower portion of the spark plug hex nut and bears against the underside of the hex nut to support a binding strap which straps around the upper end of the plug on the exterior of the boot. The interior of the boot is provided with internal flexible barbs to assist in holding the boot and maintaining it in electrical engagement with the spark plug.

Another relevant patent is Australian 145,131, which requires a special type of spark plug with a machined groove to accept a flange on the boot. The Australian boot seals the entire spark plug which permits the transfer of heat directly to the boot leading to premature failure.

U.S. Pat. No. 1,245,931 to Lanman shows a spark plug protector or boot, which is provided with screw adjustable rings on the plug-end lead as well as the wire-end lead that are screwed tightly to help secure the plug.

References that are of background interest only are:

U.S. Pat. No. 5,127,840 to Bezusko, et al: SPARK PLUG CONNECTOR

U.S. Pat. No. 5,188,537 to Itoh: FOR A SLIPPAGE PREVENTOR AND IGNITION TERMINAL CABLE U.S. Pat. No. 1,928,520 to Werner: FOR SHROUDING CAP FOR SPARK PLUGS None of these references show a simple, effective way for assuring the secure attachment of the spark plug shroud or wire cap to the spark plug electrode as contrasted with applicant's design. The device of this invention, which may be readily utilized, is simple in structure, and low in cost. Furthermore, this unique design can be used on modern type engines where the spark plug is recessed into or below the surface of the cylinder head. The new recessed engine designs are responsible for much of the increased fuel mileage and improved performance of today's vehicles. The cited references cannot be used with these modern head configurations since they physically will not fit or there is no room to manipulate their securing procedure.

The present invention provides positive control to prevent the wire boot cap from coming off the end of the plug because the tapered sleeve with concentric recesses cooperates with the internally ringed boot cap to secure the structure to that of the hub of the spark plug or distributor terminal.

SUMMARY OF THE INVENTION

This present invention provides an improved rubber insulator cover and cooperating sleeve for spark plug lead wires including a means of connecting the cap and the wire securely to the end of the spark plug in such a manner as to prevent the unwanted disconnection of the wire lead from the spark plug outer electrode.

This is achieved by providing a plurality of internal annular grooves in the portion of the rubber cap which fits over the end of the spark plug and engages the cooperating internal grooves of a hard plastic or rubber sleeve which fits over the spark plug terminal and holds the cap material tightly thereon making it impossible for the cap to slip off inadvertently due to heat, vibration and the like.

The device of this invention is designed for use on conventional spark plugs consisting of the spark electrode, threaded base, insulated porcelain cover parts and the threaded electrode contact at the end of which the distributor wire is usually fitted to the connection in a simple friction or spring fitted connection and consequently, it is subject to loosening and disconnection due to engine and road vibration.

The boot covers the electrode lead wire and at a point corresponding to where it fits over the head of the plug has specially formed, generally concentric grooves in the boot designed to engage mating projections in a tapered sleeve which fits over the spark plug terminal making it physically impossible for the wire to become disconnected from the plug electrode. The sleeve is extremely inexpensive yet effective.

An alternate embodiment of the invention comprises a boot including molded internal grooves and steel spring clips molded within the grooves to exert a clamping force on the spark plug sleeve. The boot can also include molded internal grooves combined with an outer recess to receive with an external wire tie.

Accordingly, an object of this invention is to provide a new and improved terminal cap for connecting the ignition wire to a spark plug or distributor cap in internal combustion engines.

Another object of this invention is to provide a new and improved and inexpensive terminal cap that securely fastens to a spark plug or distributor cap.

A further object of this invention is to provide a new and improved internally grooved boot, which engages the external grooves on a sleeve mounted over a spark plug terminal.

A more specific object of this invention is to provide a new and improved terminal cap for spark plugs which includes a plurality of internally molded grooves which engages a spark plug sleeve with internally molded mating grooves to hold the spark plug in a firm connection.

BRIEF DESCRIPTION OF THE DRAWINGS

The above and other objects and advantages of this invention may be more clearly seen when viewed in conjunction with the accompanying drawings wherein:

FIG. 1 comprises a cut away view of spark plug or distributor wire cap cover showing the internal grooves and wire connector;

FIG. 2*a* is a front view of the grooved adapter or shell which engages a spark plug or distributor cap terminal;

FIG. 2*b* is a cross-sectional view taken along the line 2*b*—2*b* of FIG. 2*a*

FIG. 3 shows the shell mounted on a distributor cap terminal;

DETAILED DESCRIPTION OF THE INVENTION

Figure 4:
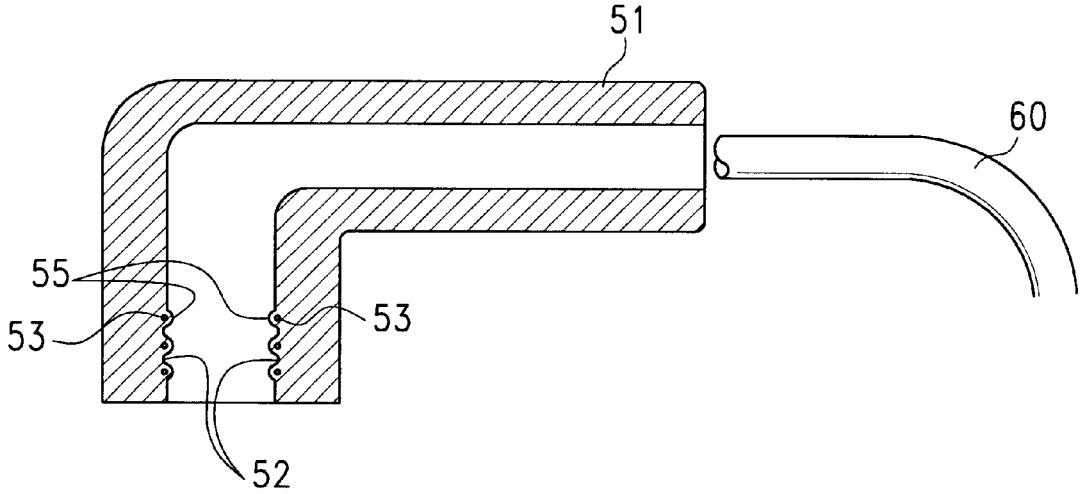
FIG. 4 is a side cross-sectional view of a boot with molded grooves and internal spring clips; and, FIG. 5 is a side cross-sectional view of a boot with molded grooves and an external recess for wire ties.

Referring now to FIG. 1 of the drawings, the invention comprises a spark plug and a distributor wire cap cover 10 comprising a hollow insulating rubber shell 11 having a downwardly extending plug cover portion 12 with an annular opening 13 formed in the end thereof. The cover portion 12 includes a plurality of spaced internal concentric grooves 14 separated by outwardly extending projections 15. The hollow terminal coupling 24 is connected to wire 16 extending outwardly from the upper portion of the boot 10 which is at a 90° angle to the downwardly extending portion 12.

A hard rubber or plastic tapered adapter or shell 20 having a plurality of spaced concentric grooves 21 is mounted over the spark plug terminal 26, (see FIG. 2, ). The grooves 21 are separated by outwardly projecting bands 22. The end of the spark plug terminal 26 extends beyond the shell 20 to engage the connecting element 24 within the cover 10. The grooves 21 mate with projecting portions 15 while grooves 14 mate with projecting portions 22. The tapered aperture 25 in the shell 20 facilitates a fit on spark plug or distributor cap terminals 26 where a heat resistant epoxy cement is used to secure the shell 20 to the distributor cap 40 or spark plug 30.

The connection between the cover 10 and shell 20 is extremely secure and will not come off the terminal 26 during ordinary or extraordinary use. The grooved adapter or shell 20 is very inexpensive and avoids the need for special terminal configurations. The shell 20 works with conventional spark plugs (not shown) and distributor caps 40 and coil towers which is a considerable advantage.

Figure 5:
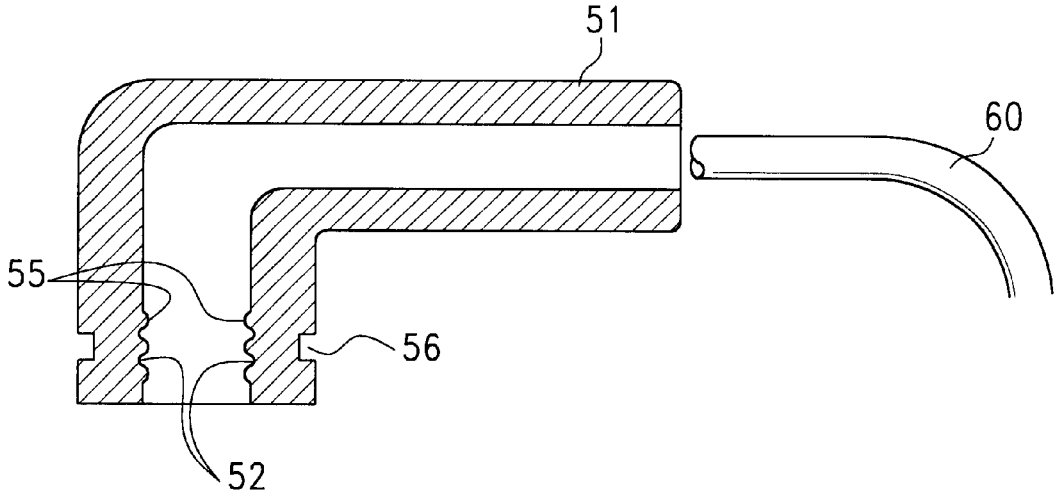

In alternate embodiments shown in FIGS. 4 and 5, the boot 51 includes molded internal grooves 52 and steel spring clips 51 molded within groove projections 55 which exert a further clamping force on the shell 20. In FIG. 5 a similar boot 61 with molded grooves and an external circumferential recess 56 for a wire tie or clip is shown. In the various embodiments the boot 51 is shaped at a predetermined angle, which is generally 90° but could vary.

The boot-shell combination clearly and assuredly prevents the wire lead 16 or 60 from falling off the end of the electrode 23 of the plug or distributor cap 40 or becoming disconnected from the distributor lead during high vibrations particularly encountered in a racing environment.

While the invention is primarily described with regard to spark plug terminals, the teaching can be applied to an ignition coil tower or distributor cap terminal 26 over which the shell 20 would be positioned. The distributor cap 40 embodiment is illustrated in FIG. 3. The concept of these mating elements to secure connections on a terminal 26 is clearly shown in the figures and can be applied in this instance as well.

While the invention has been explained by a detailed description of certain specific embodiments, it is understood that various modifications and substitutions can be made in any of them within the scope of the appended claims, which are intended also to include equivalents of such embodiments.

What is claimed is:

1. An automobile spark plug ignition wire conduit insulated terminal cap having a predetermined configuration for connection to a spark plug or distributor cap terminal comprising:

a flexible, compressible moisture proof insulating body portion of substantially annular cross-section having a first open end for receiving an insulated ignition wire and a second open end to engage a spark plug or distributor cap terminal, said second open end having a plurality of spaced concentric internal grooves and a plurality of raised bands separating said grooves including a raised band between each groove;

a tapered sleeve having a plurality of spaced external concentric grooves each separated by a raised band, said sleeve being fixedly positioned over said spark plug or distributor cap terminal; wherein the second open end of the body portion is mounted to the sleeve with the raised external bands engaging the internal grooves, on the body portion and the raised internal bands on the body portion engaging the external grooves is on the sleeve to secure the cap to the terminal.

2. An automobile spark plug ignition wire conduit insulated terminal cap in accordance with claim 1 wherein:

the cap curves at a 90° angle, said cap including a first portion for connection to an ignition wire and a second portion extending downwardly at a right angle and having the second open end for connection to the terminal.

3. An automobile spark plug ignition wire conduit insulated terminal cap in accordance with claim 1 wherein:

the second open end includes a hollow coupling mounted within the downwardly extending portion of the cap to facilitate gripping the terminal.

4. An automobile spark plug ignition wire conduit insulated terminal cap in accordance with claim 1 further including:

a plurality of hollow sleeves wherein the terminal comprises a distributor cap having a plurality of terminals extending therefrom to engage the sleeves.

5. An automobile spark plug ignition wire conduit insulated terminal cap in accordance with claim 4 wherein:

the sleeves are plastic and are force fit over the terminals.

6. An automobile spark plug ignition wire in accordance with claim 5 wherein:

the downwardly extending portion of the cap includes a plurality of wires each molded within a raised band.

7. An automobile spark plug ignition wire conduit insulated terminal cap in accordance with claim 2 wherein:

the second downwardly extending portion of the cap includes an outer portion having a recess on the outer portion and further including a wire strap mounted about said recess to secure the cap to the wire terminal.

8. An automobile spark plug ignition wire conduit insulated terminal cap in accordance with claim 1 further including:

a two part heat resistant epoxy adhesive which secures the sleeve to a terminal.

* * * * *